US007607593B2

(12) United States Patent
Akabane

(10) Patent No.: US 7,607,593 B2
(45) Date of Patent: Oct. 27, 2009

(54) ELECTROMAGNETIC FUEL INJECTION VALVE AND PROCESS FOR PRODUCING THE SAME

(75) Inventor: Akira Akabane, Miyagi (JP)

(73) Assignee: Keihin Corporation, Tokyo (JP)

( * ) Notice: Subject to any disclaimer, the term of this patent is extended or adjusted under 35 U.S.C. 154(b) by 75 days.

(21) Appl. No.: 10/590,084

(22) PCT Filed: Feb. 25, 2005

(86) PCT No.: PCT/JP2005/003129

§ 371 (c)(1),
(2), (4) Date: Jul. 9, 2007

(87) PCT Pub. No.: WO2005/083261

PCT Pub. Date: Sep. 9, 2005

(65) Prior Publication Data

US 2007/0272773 A1 Nov. 29, 2007

(30) Foreign Application Priority Data

Feb. 27, 2004 (JP) ..... 2004-053693

(51) Int. Cl.
*F02M 51/00* (2006.01)

(52) U.S. Cl. ..... 239/585.1; 239/585.4; 239/585.5

(58) Field of Classification Search ..... 239/585.1, 239/585.4, 585.5; 251/129.16, 129.21; 29/890.142
See application file for complete search history.

(56) References Cited

U.S. PATENT DOCUMENTS 4,509,693 A * 4/1985 Nakai ..... 239/585.5

5,178,362 A * 1/1993 Vogt et al. ..... 251/129.21

(Continued)

FOREIGN PATENT DOCUMENTS

JP 7-189852 A 7/1995

(Continued)

*Primary Examiner*—Len Tran
*Assistant Examiner*—Justin Jonaitis
(74) *Attorney, Agent, or Firm*—Arent Fox LLP

(57) ABSTRACT

In an electromagnetic fuel injection valve in which a non-magnetic cylinder is coaxially coupled at its front end to a rear end of a magnetic cylinder forming a portion of a valve housing to surround a portion of a movable core having a rear end face serving as a movable attraction face, and a stationary core having a front end face serving as a stationary attraction face is fitted and fixed at its front portion in a rear portion of the non-magnetic cylinder, so that the stationary attraction face is opposed to the movable attraction face, the stationary core (22) is fitted and fixed at its front portion in the non-magnetic cylinder (26), so that it is in close contact with an inner surface of an intermediate portion of the non-magnetic cylinder (26) in a region corresponding to the stationary attraction face (42), and an annular recess (44) having a flat portion (44*a*) flush connected to the stationary attraction face (42) is provided in an inner surface of the non-magnetic cylinder (26) to form an annular chamber (45) between the annular recess (44) and an outer periphery of a rear portion of the movable core (18). This makes it possible that the area of opposed faces of the stationary core and the movable core is set at a large value to the utmost, thereby preventing the accumulation and deposition of chips and a magnetic powder.

5 Claims, 4 Drawing Sheets

U.S. PATENT DOCUMENTS

| | | | | |
|---|---|---|---|---|
| 5,199,648 | A * | 4/1993 | Fujikawa | 239/585.4 |
| 5,232,166 | A | 8/1993 | Reiter | |
| 6,367,720 | B1 * | 4/2002 | Okamoto et al. | 239/585.1 |
| 6,386,467 | B1 * | 5/2002 | Takeda | 239/585.5 |
| 6,758,420 | B2 * | 7/2004 | Arioka et al. | 239/585.4 |
| 2003/0230649 | A1 | 12/2003 | Nagaoka et al. | |

FOREIGN PATENT DOCUMENTS

| | | | |
|---|---|---|---|
| JP | 7-279794 | A | 10/1995 |
| JP | 11-166461 | A | 6/1999 |
| JP | 2002-004013 | A | 1/2002 |

* cited by examiner

ELECTROMAGNETIC FUEL INJECTION VALVE AND PROCESS FOR PRODUCING THE SAME

CROSS-REFERENCE TO RELATED APPLICATION

This application is a National Stage entry of International Application No. PCT/JP2005/003129, filed Feb. 25, 2005, the entire specification claims and drawings of which are incorporated herewith by reference.

TECHNICAL FIELD

The present invention relates to an electromagnetic fuel injection valve, in which a valve member is contained in a valve housing comprising a magnetic cylinder coaxially coupled at a front end thereof to a valve seat member having a valve seat, the valve member being spring-biased in a direction in which the valve member is seated on the valve seat; a non-magnetic cylinder is coaxially coupled at a front end thereof to a rear end of the magnetic cylinder to surround a portion of a movable core which is coaxially connected to the valve member with a rear end face thereof serving as a movable attraction face; and a front portion of a stationary core having a front end face serving as a stationary attraction face is fitted into and fixed in a rear portion of the non-magnetic cylinder, so that the stationary attraction face is opposed to the movable attraction face, and a process for producing such an electromagnetic fuel injection valve.

BACKGROUND ART

There is an electromagnetic fuel injection valve already known from, for example, Patent Document 1, wherein a non-magnetic cylinder is coaxially coupled to a rear end of a magnetic cylinder forming a portion of a valve housing, and a front portion of a stationary core is fitted into and fixed in a rear portion of the non-magnetic cylinder.

Patent Document 1:

Japanese Patent Application Laid-open No. 11-166461

DISCLOSURE OF THE INVENTION

Problems to be Solved by the Invention

In the above conventional electromagnetic fuel injection valve, a tapered chamfer is provided around an outer periphery of the front end of the stationary core in order to improve the operability for fitting the front portion of the stationary core into the rear end of the non-magnetic cylinder, and such chamfer is left as it is, after completion of the assembling. However, it is desired to set the area of opposed faces of the stationary core and the movable core at a large value to the utmost in order to reduce the size of the fuel injection valve, but if there is the chamfer formed around outer periphery of the front end of the stationary core, as described above, such area may be reduced, whereby a sufficient attraction force is not obtained in some cases. Moreover, an annular groove is formed by the chamfer between the non-magnetic cylinder and the stationary core and thus, there is a possibility that chips and a magnetic powder may enter the annular groove to become deposited therein, and even if a removal cleaning is conducted, the chips or magnetic powder are not removed completely to exert an adverse influence to the operation of the fuel injection valve.

The present invention has been accomplished with such circumstances in view, and it is a first object of the present invention to provide an electromagnetic fuel injection valve, wherein the area of the opposed faces of the stationary core and the movable core can be set at a large value to the utmost and moreover, it is possible to prevent the accumulation and deposition of the chips and the magnetic powder. It is a second object of the present invention to provide a producing process suitable for producing such an electromagnetic fuel injection valve.

Means for Solution of Problems

To achieve the above first object, according to a first aspect of the present invention, there is provided an electromagnetic fuel injection valve, in which a valve member is contained in a valve housing comprising a magnetic cylinder coaxially coupled at a front end thereof to a valve seat member having a valve seat, the valve member being spring-biased in a direction in which the valve member is seated on the valve seat; a non-magnetic cylinder serving as a member different from the magnetic cylinder is coaxially coupled at a front end thereof to a rear end of the magnetic cylinder to surround a portion of a movable core which is coaxially connected to the valve member with a rear end face thereof serving as a movable attraction face; and a front portion of a stationary core having a front end face serving as a stationary attraction face is fitted into and fixed in a rear portion of the non-magnetic cylinder, so that the stationary attraction face is opposed to the movable attraction face, characterized in that the front portion of the stationary core is fitted and fixed in the non-magnetic cylinder so as to be in close contact with an inner surface of an intermediate portion of the non-magnetic cylinder in a region corresponding to the stationary attraction face, and in the inner peripheral surface of the non-magnetic cylinder, an annular recess having a flat portion flush connected to the stationary attraction face is provided to form an annular chamber between the annular recess and an outer periphery of the rear portion of the movable core, and in the inner peripheral surface of said non-magnetic cylinder, a center bore having an inside diameter larger than an outside diameter of the stationary attraction face is further provided at a location in front of the annular recess, a guide bore is provided in an inner periphery of the magnetic cylinder and flush connected to the center bore of the non-magnetic cylinder, and the annular chamber is formed by continuously connecting the flat portion of said annular recess and the center bore and guide bore by means of an inclined surface.

According to a second aspect of the present invention, in addition to the arrangement of the first aspect, a guide portion is integrally provided on the movable core having at a rear end face thereof the movable attraction face having an outside diameter substantially equal to that of the stationary attraction face to overhang sideways from the outer periphery of the movable attraction face, so that the guide portion is slidably fitted in the guide bore.

To achieve the above second object, according to a third aspect of the present invention, there is provided a process for producing an electromagnetic fuel injection valve according to the first aspect, comprising a step of preparing a cylindrical magnetic cylinder blank and a non-magnetic cylinder blank for forming the magnetic cylinder and the non-magnetic cylinder, respectively, as well as a stationary core blank having a chamfer around the outer periphery at a front end thereof for forming the stationary core; a step of fixing the stationary core blank to the non-magnetic cylinder blank in a state in which a front portion of the stationary core blank has been fitted so as to be in close contact with an inner surface of an intermediate portion of the non-magnetic cylinder blank coaxially coupled to the magnetic cylinder blank; and a step of grinding the front portion of the stationary core blank so as to remove the chamfer, thereby forming a flat stationary attraction face, and subjecting inner peripheries of the non-magnetic cylinder blank and the magnetic cylinder blank to a grinding to form the annular recess, the center bore and the guide bore, the above steps being carried out sequentially.

EFFECT OF THE INVENTION

With the first feature of the present invention, the outer periphery of the stationary attraction face at the front end of the stationary core is flush connected to the flat portion of the annular recess provided in the inner periphery of the non-magnetic cylinder. Therefore, as compared with a stationary core having a chamfer provided around its outer periphery at its front end, it is possible to set the area of the stationary attraction face at a large value to the utmost to provide an increase in attraction force. In addition, an annular groove cannot be formed between the stationary core and the non-magnetic cylinder, and the annular chamber is defined between the movable core and the non-magnetic cylinder to surround the outer periphery of the rear portion of the movable core. Therefore, even if chips and a magnetic powder are produced, they can be fluidized and thus, can be prevented from being accumulated and deposited. More specifically, the annular recess forming the annular chamber between the rear outer periphery of the movable core and the annular recess is to be formed at the inner peripheral surface of the non-magnetic cylinder serving as a member different from the magnetic cylinder, and therefore, even if the annular recess is formed, the magnetic characteristic of the structure surrounding this annular recess is not changed. Further, the annular recess is formed to have a flat portion flush connected to the stationary attraction face of the stationary core, and the center bore having an inside diameter larger than an outside diameter of the stationary attraction face is provided in an inner periphery of the non-magnetic cylinder at a location in front of the annular recess, and on the other hand, the guide bore is provided in the inner periphery of the magnetic cylinder coaxially connected at the front end and the rear end of the non-magnetic cylinder, and the annular chamber is formed by continuously connecting the flat portion of the annular recess and the center bore and guide by means of an inclined surface. Therefore, the above-described chips and magnetic powder are fluidized on smooth continuous surfaces including the inclined surface of the annular recess formed in the non-magnetic cylinder and can extremely effectively be prevented from being accumulated and deposited there.

With the second feature of the present invention, an attraction force can be further increased by setting the outside diameter of the movable attraction face at a value substantially equal to that of the stationary attraction face. Moreover, the movable core is guided in the guide bore in the magnetic cylinder and hence, it is possible to provide an enhancement in attraction responsiveness.

With the third feature of the present invention, when the front portion of the stationary core blank is fitted into and fixed in the non-magnetic cylinder blank, an operation of fitting and fixing the stationary core blank in the non-magnetic cylinder blank is easy, because the stationary core blank has the chamfer around its outer periphery at its front end. Moreover, the stationary attraction face, the annular recess, the center bore and the guide bore are formed by the grinding of the stationary core blank, the non-magnetic cylinder blank and the magnetic cylinder blank, and hence, a dust such as chips produced by the fitting and the chamfer can be removed by the grinding.

DESCRIPTION OF REFERENCE NUMERALS AND CHARACTERS

Figure 1:
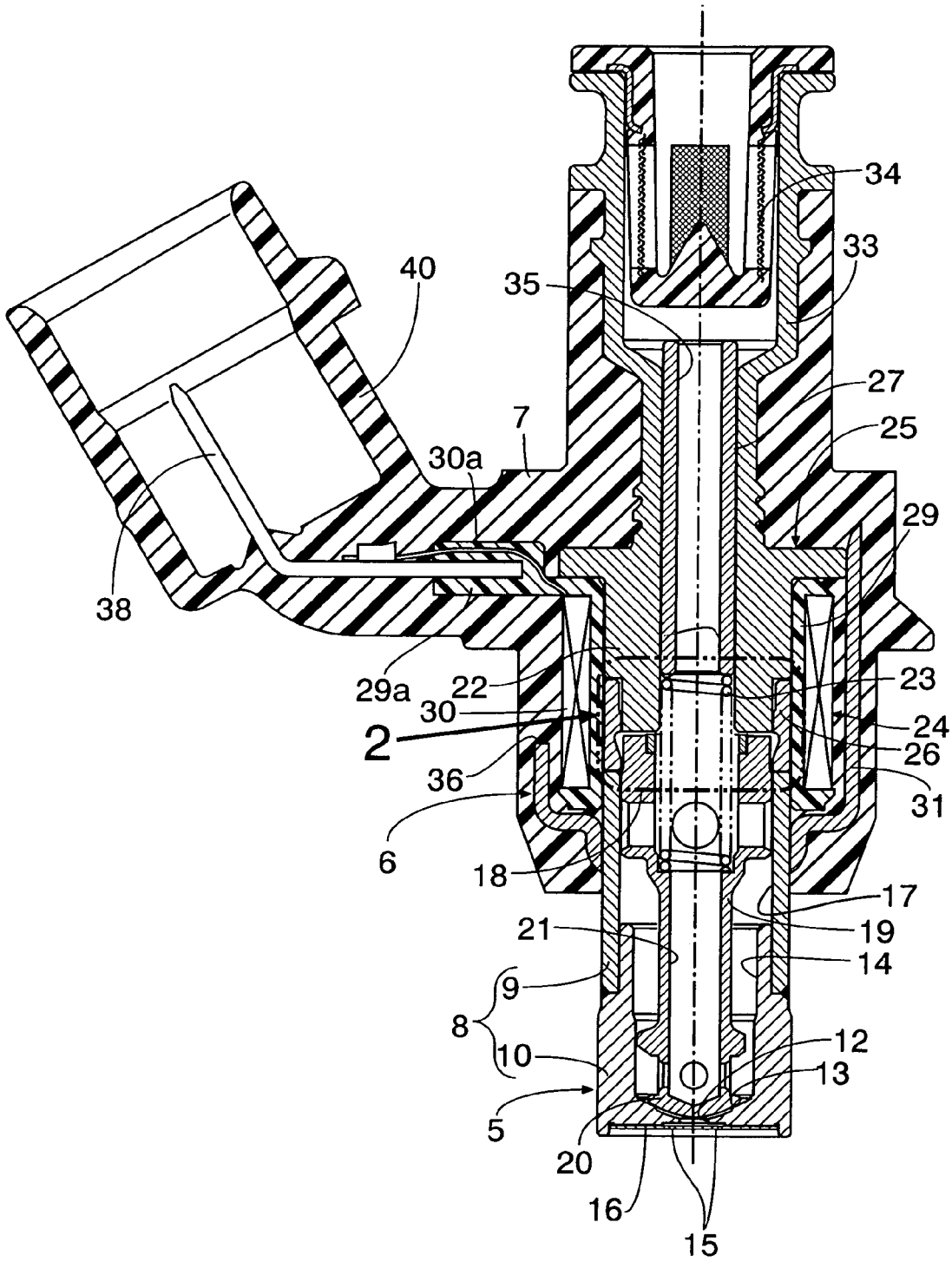
[FIG. 1] is a vertical sectional view of an electromagnetic fuel injection valve. (Embodiment 1)

8 . . . Valve housing
9 . . . Magnetic cylinder
9' . . . Magnetic cylinder blank
10 . . . Valve seat member
13 . . . Valve seat
17 . . . Guide bore
18 . . . Movable core
20 . . . Valve member
22 . . . Stationary core
22' . . . Stationary core blank
26 . . . Non-magnetic cylinder
26' . . . Non-magnetic cylinder blank
41 . . . Movable attraction face
42 . . . Stationary attraction face
44 . . . Annular recess
44*a* . . . Flat portion
45 . . . Annular chamber
46 . . . Center bore
47 . . . Guide portion
48 . . . Chamfer

BEST MODE FOR CARRYING OUT THE INVENTION

The mode for carrying out the present invention will now be described by way of one embodiment of the present invention shown in the accompanying drawings.

Embodiment 1

FIGS. 1 to 4 show one embodiment of the present invention.

Referring first to FIG. 1, an electromagnetic fuel injection valve for injecting fuel into an engine which is not shown includes a valve section 5 which comprises a valve housing 8 having a valve seat 13 at its front end, and a valve member 20 contained in the valve housing and spring-biased in a direction to be seated on the valve seat 13, a solenoid section 6 in which a coil assembly 24 capable of exhibiting an electromagnetic force for driving the valve member 20 in a direction to be unseated from the valve seat 13 is contained in a solenoid housing 25 connected to the valve housing 8, and a covering section 7 made of a synthetic resin which is integrally provided with a coupler 40 faced by connection terminals 38 connected to a coil 30 of the coil assembly 24 and in which at least the coil assembly 24 and the solenoid housing 25 are embedded.

The valve housing 8 is comprised of a magnetic cylinder 9 formed of a magnetic metal, and a valve seat member 10 liquid-tightly coupled to a front end of the magnetic cylinder 9. The valve seat member 10 is welded to the magnetic cylinder 9 in a state in which its rear end has been fitted into a front end of the magnetic cylinder 9. The valve seat member 10 includes a fuel outlet bore 12 opening into a front end face of the valve seat member 10, a tapered valve seat 13 connected to an inner end of the fuel outlet bore 12, and a guide bore 14 connected to a larger-diameter portion at a rear end of the valve seat 13, all of which are coaxially provided in the valve seat member 10. An injector plate 16 made of a steel plate having a plurality of fuel injection bores 15 leading to the fuel outlet bore 12 is liquid-tightly welded over the entire periphery to a front end of the valve seat member 10.

A movable core 18 forming a portion of the solenoid section 6 is slidably received in a rear portion of the valve housing 8, and the valve member 20 capable of being seat on the valve seat 13 to close the fuel outlet bore 12 is integrally formed at a front end of a valve stem 19 integrally connected to the movable core 18, so that it is guided in the guide bore 14. A through-hole 21 is coaxially formed in a bottomed configuration with its front end closed in the movable core 18, the valve stem 19 and the valve member 20 to lead to the inside of the valve housing 8.

The solenoid section 6 includes the movable core 18, a cylindrical stationary core 22 opposed to the movable core 18, a return spring 23 for exhibiting a spring force for biasing the movable core 18 away from the stationary core 22, the coil assembly 24 disposed to surround the rear portion of the valve housing 8 and the stationary core 22, while enabling the exhibition of an electromagnetic force for attracting the movable core 18 toward the stationary core 22 again the spring force of the return spring 23, and the solenoid housing 25 provided to surround the coil assembly 24 in such a manner that a front end of the solenoid housing 25 is connected to the valve housing 8.

The magnetic cylinder 9 of the valve housing 8 is coaxially coupled at its rear end to a front end of the stationary core 22 through a non-magnetic cylinder 26 formed of a material which is non-magnetic or magnetic weakly more than the stationary core 22, for example, a non-magnetic metal such as a stainless steel in the present embodiment. The rear end of the magnetic cylinder 9 is butt-welded to the front end of the non-magnetic cylinder 26, and the rear end of the non-magnetic cylinder 26 is welded to the stationary core 22 in a state in which the front end of the stationary core 22 has been fitted into the non-magnetic cylinder 26.

A cylindrical retainer 27 is coaxially fitted into and fixed to the stationary core 22 by caulking, and the return spring 23 is interposed between the retainer 27 and the movable core 18. A ring-shaped stopper 28 made of a non-magnetic material is press-fitted into an inner periphery of a rear end of the movable core 18 in such a manner that it protrudes slightly from a rear end face of the movable core 18 toward the stationary core 22 in order to avoid the direct contact of the movable core 18 with the stationary core 22. The coil assembly 24 comprises the coil 30 wound around a bobbin 29 which surrounds the rear portion of the valve housing 8, the non-magnetic cylinder 26 and the stationary core 22.

The solenoid housing 25 comprises a magnetic frame 31 which is formed of a magnetic metal in a cylindrical shape surrounding the coil assembly 24 and has at one end an annular end wall 31*a* opposed to an end of the coil assembly 24 closer to the valve section 5, and a flange 22*a* overhanging radially outwards from the rear end of the stationary core 22 and opposed to an end of the coil assembly 24 opposite from the valve section 5. The flange 22*a* is magnetically coupled to the other end of the magnetic frame 31. Moreover, a fitting cylindrical portion 31*b* is coaxially provided on an inner periphery of the end wall 31*a* of the magnetic frame 31, and the magnetic cylinder 9 of the valve housing 8 is fitted into the fitting cylindrical portion 31*b*. The solenoid housing 25 is connected to the valve housing 8 by fitting the valve housing 8 into the fitting cylindrical portion 31*b*.

A cylindrical inlet tube 33 is integrally and coaxially connected to the rear end of the stationary core 22, and a fuel filter 34 is mounted in a rear portion of the inlet tube 33. Moreover, a fuel passage 35 is coaxially provided in the inlet tube 33, the retainer 23 and the stationary core 22 to lead to the through-hole 21 in the movable core 18.

The covering section 7 is formed so that not only the solenoid housing 25 and the coil assembly 24 but also a portion of the valve housing 8 and most of the inlet tube 33 are embedded in the covering section 7, while ensuring that a gap between the solenoid housing 25 and the coil assembly 24 is filled. The magnetic frame 31 of the solenoid housing 25 is provided with a notch 36 for disposing an arm portion 29*a* integrally formed on the bobbin 29 of the coil assembly 24 outside the solenoid housing 25.

The covering section 7 is integrally provided with the coupler 40 faced by the connection terminals 38 connected to opposite ends of the coil 30 of the coil assembly 24. Base ends of the connection terminals 38 are embedded in the arm portion 29*a*, and coil ends 30*a* of the coil 30 are welded to the connection terminals 38.

Figure 2:
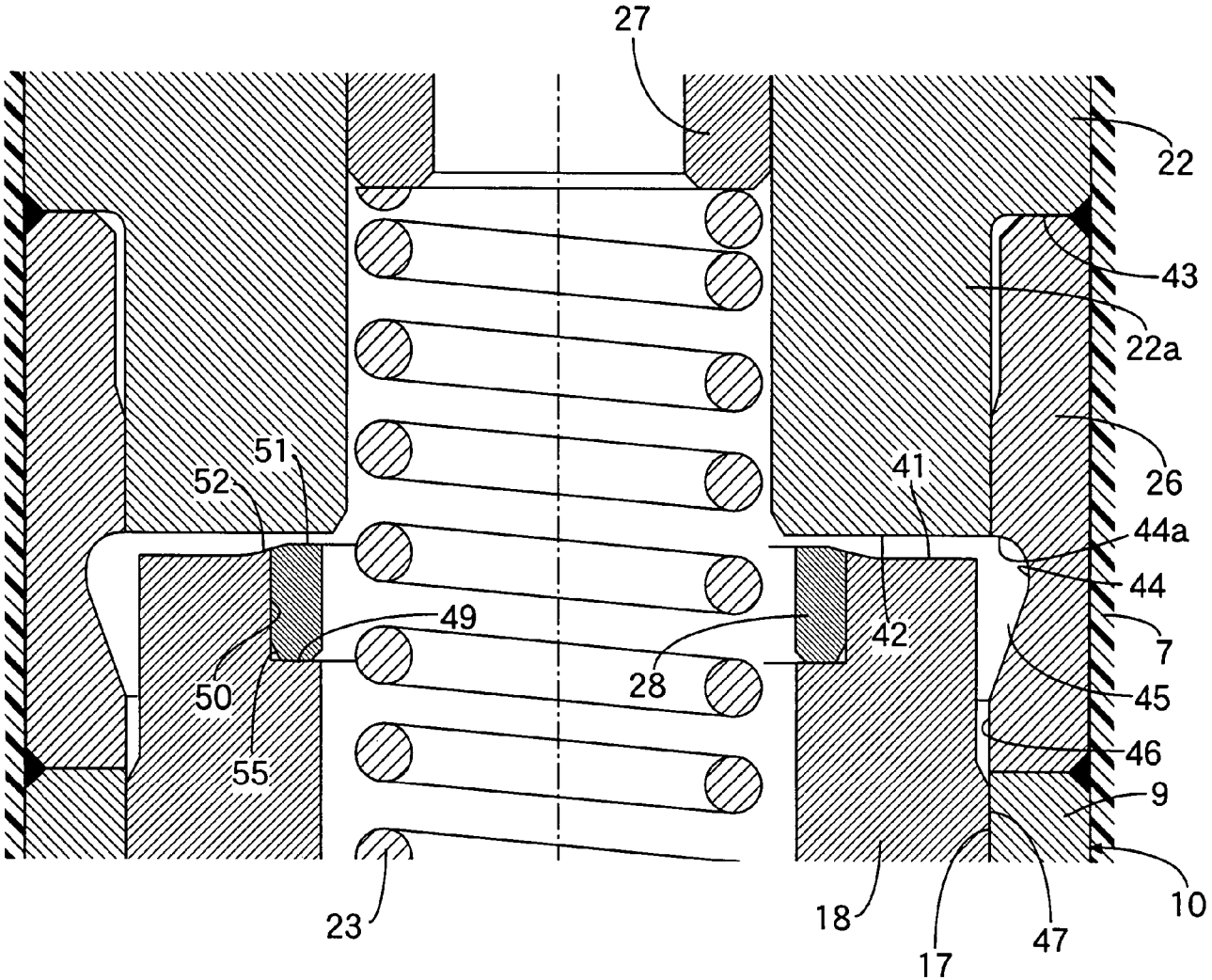
[FIG. 2] is an enlarged view of an area shown by an arrow 2 in FIG. 1. (Embodiment 1)

Referring to FIG. 2, the non-magnetic cylinder 26 is coaxially coupled at its front end by butt-welding to the rear end of the magnetic cylinder 9 of the valve housing 8 so as to surround a portion of the movable core 18 having the rear end face serving as a movable attraction face 41. A front portion of the stationary core 22 having a front end face serving as a stationary attraction face 42 is fitted into and fixed in a rear portion of the non-magnetic cylinder 26 in such a manner that the stationary attraction face 42 is oppose to the movable attraction face 41.

A smaller-diameter fitting portion 22*a* is coaxially provided in the front area of the stationary core 22 to form an annular step 43 facing forwards around its outer periphery, so that the stationary attraction face 42 is formed at a front end of the smaller-diameter fitting portion 22*a*. The smaller-diameter fitting portion 22*a* is fitted into the rear portion of the non-magnetic cylinder 26 until the step 43 abuts against the rear end of the non-magnetic cylinder 26, so that the smaller-diameter fitting portion 22*a* is in close contact with an inner surface of an intermediate portion of the non-magnetic cylinder 26 in a region corresponding to the stationary attraction face 42. In this state, the stationary core 22 is fixed to the non-magnetic cylinder 26 by welding.

Moreover, an annular recess 44 having a flat portion 44*a* flush connected to an outer periphery of the stationary attraction face 42 of the stationary core 22 is provided in the inner surface of the non-magnetic cylinder 26 to form an annular chamber 45 between the annular recess 44 and an outer periphery of the rear portion of the movable core 18.

A center bore 46 having an inside diameter larger than an outside diameter of the stationary attraction face 42 is formed in an inner periphery of the non-magnetic cylinder 26 at a location in front of the annular recess 44, and a guide bore 17 having a diameter larger than that of the guide bore 14 in the valve seat member 10 is provided in an inner periphery of the magnetic cylinder 9, so that it is flush connected to the center bore 46.

On the other hand, the movable attraction face 41 having a diameter substantially equal to that of the stationary attraction face 42 is formed on the rear end face of the movable core 18, but a guide portion 47 is integrally provided on the movable core 18 to overhang sideways from the outer periphery of the movable attraction face 41, so that it is slidably fitted in the guide bore 17.

Figure 3:
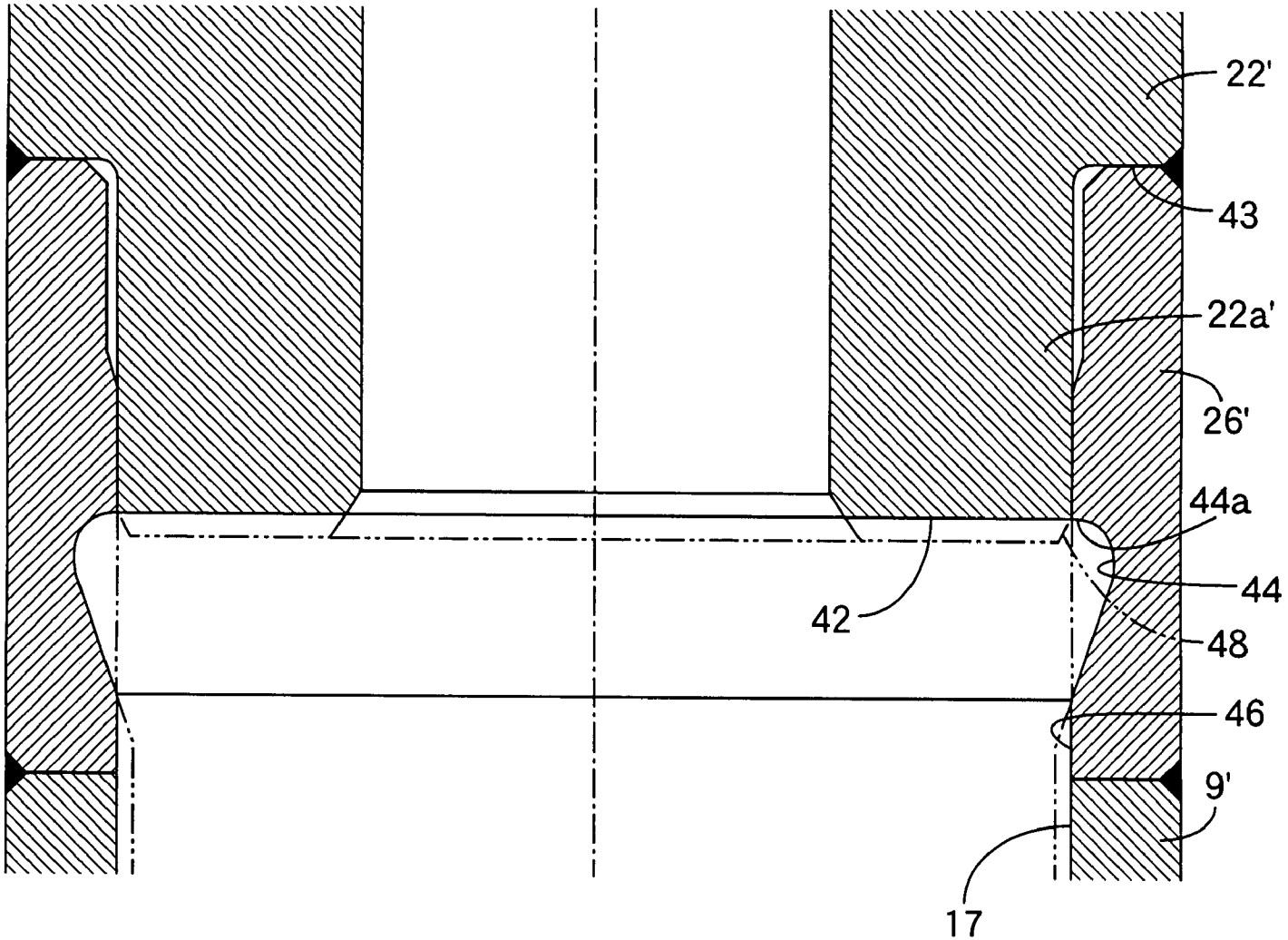
[FIG. 3] is a sectional view for explaining the grinding of a stationary core blank, a non-magnetic cylinder blank and a magnetic cylinder blank. (Embodiment 1)

Referring to FIG. 3, to couple the stationary core 22 to the rear portion of the valve housing 8 through the non-magnetic cylinder 26, at first, a cylindrical magnetic cylinder blank 9' a ring-shaped non-magnetic cylinder blank 26' and a stationary core blank 22' having shapes shown by dashed lines in FIG. 3, are prepared in order to form the magnetic cylinder 9, the non-magnetic cylinder 26 and the stationary core 22.

The non-magnetic cylinder blank 26' is formed into a cylindrical shape having an inner periphery increased in diameter at three stages in a rearward direction, and the magnetic cylinder blank 9' is formed into a cylindrical shape having an inside diameter corresponding to an inside diameter of a front end of the non-magnetic cylinder blank 26'. Further, the stationary core blank 22' is formed to previously have a front portion of a smaller-diameter tube portion 22*a*' corresponding to the smaller-diameter fitting portion 22*a* of the stationary core 22, and an annular step 43 surrounding a base end of the smaller-diameter tube portion 22*a*'. The length of protrusion of the smaller-diameter tube portion 22*a*' from the step 43 is set at a value larger than the length of protrusion of the smaller-diameter fitting portion 22*a* from the step 43. Moreover, a tapered chamfer 48 is provided around an outer periphery of a front end of the smaller-diameter tube portion 22*a*'.

Then, the smaller-diameter tube portion 22*a*' is fitted into the non-magnetic cylinder blank 26', so that the outer periphery of the front area of the smaller-diameter tube portion 22*a*' is in close contact with the inner surface of the intermediate portion of the non-magnetic cylinder blank 26' already coaxially coupled to the magnetic cylinder blank 9', and in a state in which the rear end of the non-magnetic cylinder blank 26' is in abutment against the step 43, the stationary core blank 22' is fixed to the non-magnetic cylinder blank 26' by welding.

In this case, the operation of fitting the front portion of the stationary core blank 22', i.e., the smaller-diameter tube portion 22*a*' into the non-magnetic cylinder blank 26' is easy, because the chamfer 48 is provided around the outer periphery of the front end of the smaller-diameter tube portion 22*a*' at the front portion of the stationary core blank 22', and the non-magnetic cylinder blank 26' is formed into the cylindrical shape having the inner periphery increased in diameter at the three stages in the rearward direction.

After the coupling of the stationary core blank 22', the non-magnetic cylinder blank 26' and the magnetic cylinder blank 9' as described above, the front portion of the smaller-diameter tube portion 22*a*' of the stationary core blank 22' is ground to remove the chamfer 48, whereby a flat stationary attraction face 42 is formed, and the inner peripheries of the non-magnetic cylinder blank 26' and the magnetic cylinder blank 9' are subjected to a grinding treatment, whereby an annular recess 44, a center bore 46 and a guide bore 17 are formed.

Referring again to FIG. 2, the recess 50 having the annular step 49 facing rearwards at its inner end is provided in the inner periphery of the rear portion of the movable core 18, and the ring-shaped stopper 28 is press-fitted into the recess 50 in such a manner that its front end abuts against the step 49. A flat abutment face 51 is disposed at a location displaced from the flat movable attraction face 41 formed at the rear end of the movable core 18 toward the stationary attraction face 42, and is formed to be able to abut against the stationary attraction face 42 at the rear end of the stopper 28. A slant 52 is formed in a tapered shape or an arcuate shape on the inner periphery of the rear end of the movable core 18 and the outer periphery of the rear end of the stopper 28 to connect continuously and smoothly the movable attraction face 41 and the abutment face 51 to each other.

Figure 4:
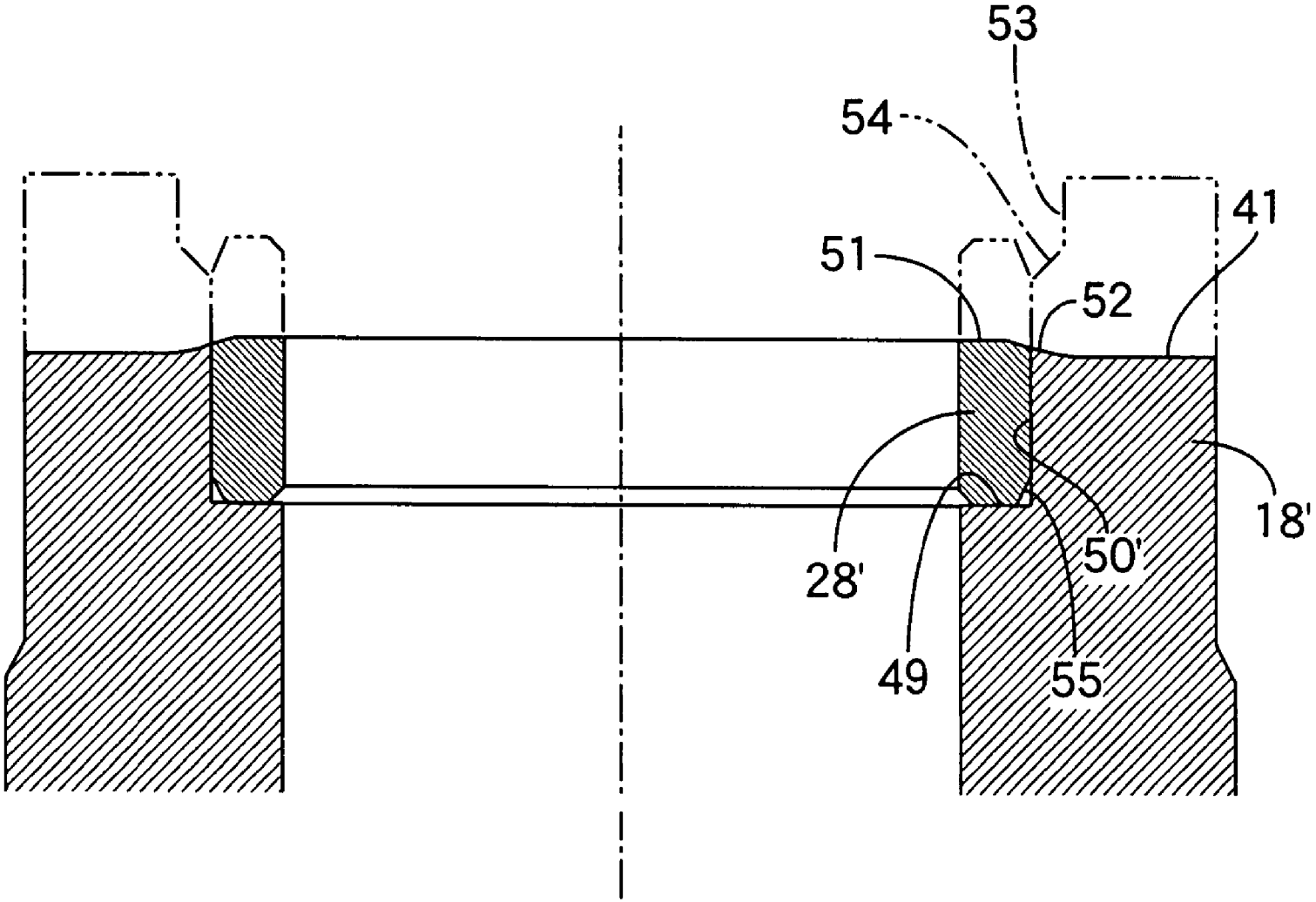
[FIG. 4] is a sectional view for explaining the grinding of a movable core blank and a stopper blank. (Embodiment 1)

Referring to FIG. 4, to couple the stopper 28 to the movable core 18, at first, a cylindrical movable core blank 18' and a ring-shaped stopper blank 28' having shapes shown by dashed lines in FIG. 4 are prepared in order to form the movable core 18 and the stopper 28, respectively.

The movable core blank 18' is formed into a cylindrical shape extending longer rearwards than the movable core 18 to be formed. Provided in an inner periphery of a rear portion of the movable core blank 18' are a smaller-diameter bore 50' corresponding to the recess 50 in the movable core 18 to form an annular step 49 at an inner end, and a larger-diameter bore 53 which is formed at a diameter larger than that of the smaller-diameter bore 50' and which is coaxially connected to a rear end of the smaller-diameter bore 50' and opens into a rear end of the movable core blank 18', so that the smaller-diameter bore 50' is longer than the recess 50. A tapered step 54 is formed between the smaller-diameter bore 50' and the larger-diameter bore 53. On the other hand, the stopper blank 28' is also axially longer than the stopper 28 to be formed, and a tapered chamfer 55 is provided around an outer periphery of a front end of the stopper blank 28'.

Then, the front end of the stopper blank 28' is press-fitted into the smaller- diameter bore 50' in the rear portion of the movable core blank 18', until the front end of the stopper blank 28' abuts against the step 49. In this case, an operation of press-fitting the stopper blank 28' into the smaller-diameter bore 50' in the rear portion of the movable core blank 18' is easy, because the rear end of the smaller-diameter bore 50' is connected to the larger-diameter bore 53 opening into the rear end of the movable core blank 18' through the tapered step 54, and the chamfer 55 is provided around the outer periphery of the front end of the stopper blank 28'.

After press-fitting of the stopper blank 28' into the rear portion of the movable core blank 18', the rear ends of the stopper blank 28' and the movable core blank 18' are ground, whereby a movable attraction face 41, an abutment face 51 and a slant 52 are formed. In addition, the rear portion of the stopper blank 28' and the rear portion of the movable core blank 18' are cut off, and the recess 50 is formed by a portion of the smaller-diameter bore 50'.

Next, the operation of this embodiment will be described below. The front portion of the stationary core 22 is fitted and fixed in the non-magnetic cylinder 26 in such a manner that it is in close contact with the inner surface of the intermediate portion of the non-magnetic cylinder 26 in the region corresponding to the stationary attraction face 42, and the annular recess 44 having the flat portion 44*a* flush connected to the stationary attraction face 42 is provided in the inner surface of the non-magnetic cylinder 26, so that the annular chamber 45 is defined between the annular recess 44 and the outer periphery of the rear portion of the movable core 18. Therefore, as compared with a stationary core having a chamfer provided around its outer periphery at its front end, it is possible to set the area of the stationary attraction face 42 at a large value to the utmost to provide an increase in attraction force. In addition, an annular groove cannot be formed between the stationary core 22 and the non-magnetic cylinder 26, and the annular chamber 45 is defined between the movable core 18 and the non-magnetic cylinder 26 to surround the outer periphery of the rear portion of the movable core 18. Therefore, even if chips and a magnetic powder are produced, they can be fluidized and thus, can be prevented from being accumulated and deposited.

In addition, the center bore 46 having the inside diameter larger than the outside diameter of the stationary attraction face 42 is formed in the inner periphery of the non-magnetic cylinder 26 at the location in front of the annular recess 44; the guide bore 17 is provided in the inner periphery of the magnetic cylinder 9, so that it is flush connected to the center bore 46; and the movable core 18 provided at its rear end face with the movable attraction face 41 having the outside diameter substantially equal to the that of the stationary attraction face 42 has the guide portion 47 integrally provided thereon to overhang sideways of the outer periphery of the movable attraction face 41, so that the guide portion 47 is slidably fitted into the guide bore 17. Therefore, the attraction force can be further increased by setting the outside diameter of the movable attraction face 41 at the value substantially equal to the outside diameter of the stationary attraction face 42, and moreover, an enhancement in attraction responsiveness can be provided in such a manner that the movable core 18 is guided in the guide bore 17 in the magnetic cylinder 9.

To couple the stationary core 22 to the rear portion of the valve housing 8 through the non-magnetic cylinder 26, the following steps are carried out sequentially: a step of preparing the cylindrical magnetic cylinder blank 9' and the non-magnetic cylinder blank 26' for forming the magnetic cylinder 9 and the non-magnetic cylinder 26, respectively, as well as the stationary core blank 22' having the chamfer 48 around its outer periphery at its front end for forming the stationary core 22, a step of fixing the stationary core blank 22' to the non-magnetic cylinder blank 26' in a state in which the front end of the stationary core blank 22' has been fitted to come into close contact with the inner surface of the intermediate portion of the non-magnetic cylinder blank 26' coaxially coupled to the magnetic cylinder blank 9', and a step of grinding the front portion of the stationary core blank 22' so as to remove the chamfer 48, thereby forming the flat stationary attraction face 42, and subjecting the inner peripheries of the non-magnetic cylinder blank 26' and the magnetic cylinder blank 9' to the grinding to form the annular recess 44, the center bore 46 and the guide bore 14.

Therefore, when the front portion of the stationary core blank 22' is fitted and fixed in the non-magnetic cylinder blank 26', the fitting and fixing operation is easy, because the stationary core blank 22' has the chamfer 48 around the outer periphery at its front end. Moreover, the stationary attraction face 42, the annular recess 44, the center bore 46 and the guide bore 17 are formed by the grinding of the stationary core blank 22', the non-magnetic cylinder blank 26' and the magnetic cylinder blank 9' and hence, a dust such as chips produced by the fitting and the chamfer 48 can be removed by the grinding.

In addition, the ring-shaped stopper 28 made of a material non-magnetic or weakly magnetic more than the movable core 18 is press-fitted into the inner periphery of the rear portion of the movable core 18. The flat abutment face 51 is disposed at the location displaced from the flat movable attraction face 41 formed at the rear end of the movable core 18 toward the stationary attraction face 42 of the stationary core 22, and is formed at the rear end of the stopper 28 to be able to abut against the stationary attraction face 42. The slant 52 is formed on the inner periphery of the rear end of the movable core 18 and the outer periphery of the rear end of the stopper 28 to continuously and smoothly connect the movable attraction face 42 and the abutment face 51 to each other.

Therefore, when the movable core 18 has been attracted to the stationary core 22, the stopper 28 is put into abutment against the stationary attraction face 42. Thus, a suitable air gap can be retained between the stationary and movable attraction faces 41 and 42, and the stopper 28 is press-fitted in the inner periphery of the rear portion of the movable core 18 and hence, it is possible to decrease the number of parts and the number of assembling steps to provide a reduction in cost.

Moreover, by setting the area of the abutment face 51 at a small value to the utmost to reduce the area of contact of the abutment face 51 with the stationary attraction face 42, it is possible to suppress the adherence of the abutment face 51 to the stationary attraction face 42 and to suppress the wear of the abutment face 51 due to the contact to enhance the durability.

Formed on the inner periphery of the rear end of the movable core 18 and the outer periphery of the rear end of the stopper 28 is the slant 52 which continuously and smoothly connects the flat movable attraction face 41 and the flat abutment face 51 disposed at the location displaced from the movable attraction face 41 toward the stationary core 22. Therefore, an annular groove cannot be formed between the outer periphery of the stopper 28 and the inner periphery of the rear end of the movable core 18 and hence, it is possible to prevent the entrance and deposition of chips or a magnetic power, thereby preventing the generation of an adverse influence to the operation of the fuel injection valve due to the chips or the magnetic power.

Further, it is possible to substantially increase the area of application of an electromagnetic attraction force to the movable core 18 by a portion of the slant 52 continuously and smoothly connecting the flat movable attraction face 42 and the flat abutment face 51 to each other, thereby ensuring a sufficient attraction force and a responsiveness despite the reduction in size of the electromagnetic fuel injection valve.

In addition, to couple the stopper 28 to the movable core 18, the following steps are carried out sequentially: the step of preparing the cylindrical movable core blank 18' and the ring-shaped stopper blank 28' for forming the movable core 18 and the stopper 28, respectively, the step of press-fitting the front portion of the stopper blank 28' into the movable core blank 18' to fix the stopper blank 28' in to the movable core blank 18', and the step of grinding the rear portions of the stopper blank 28' and the movable core blank 18' to form the movable attraction face 41, the abutment face 51 and the slant 52. Therefore, the dust such as the chips produced by the press-fitting can be removed by the grinding.

Although the embodiment of the present invention has been described, it will be understood that the present invention is not limited to the above-described embodiment, and various modifications in design may be made without departing from the scope of the present invention defined in claims.

The invention claimed is:

1. An electromagnetic fuel injection valve comprising:

a valve member contained in a valve housing comprising a magnetic cylinder coaxially coupled at a front end thereof to a valve seat member having a valve seat, said valve member being spring-biased in a direction in which said valve member is seated on said valve seat, wherein an outer diameter of said magnetic cylinder and an outer diameter of said valve seat member are equal to each other;

a non-magnetic cylinder serving as a member different from said magnetic cylinder is coaxially coupled at a front end thereof to a rear end of the magnetic cylinder to surround a portion of a movable core which is coaxially connected to said valve member with a rear end face thereof serving as a movable attraction face;

a stationary core having a front portion that includes a front end face serving as a stationary attraction face is fitted into and fixed in a rear portion of said non-magnetic cylinder, so that said stationary attraction face is opposed to said movable attraction face, wherein the front portion of said stationary core is fitted and fixed in said non-magnetic cylinder to be in close contact with an inner surface of an intermediate portion of said non-magnetic cylinder in a region corresponding to said stationary attraction face;

an annular recess having a flat portion in communication with said stationary attraction face;

an annular chamber;

a center bore having an inside diameter larger than an outside diameter of said stationary attraction face is defined by the inner peripheral surface of said non-magnetic cylinder and in communication with said annular recess; and a guide bore defined by an inner periphery of said magnetic cylinder and in communication with said center bore, wherein said annular chamber is defined by said flat portion of said annular recess being connected to said center bore and guide bore by an inclined surface and by an area between said annular recess, an outer periphery of said movable core, and an inner peripheral surface of said non-magnetic cylinder.

2. An electromagnetic fuel injection valve according to claim 1, wherein a guide portion is integrally provided on said movable core having at a rear end face thereof said movable attraction face having an outside diameter substantially equal to that of said stationary attraction face to overhang sideways from the outer periphery of said movable attraction face, wherein said guide portion is slidably fitted in said guide bore.

3. A process for producing an electromagnetic fuel injection valve according to claim 1, comprising the following steps:

a step of preparing a cylindrical magnetic cylinder blank and a non-magnetic cylinder blank for forming said magnetic cylinder and said non-magnetic cylinder, respectively, as well as a stationary core blank having a chamfer around the outer periphery at a front end thereof for forming said stationary core;

a step of fixing said stationary core blank to said non-magnetic cylinder blank in a state in which a front portion of said stationary core blank has been fitted so as to be in close contact with an inner surface of an intermediate portion of said non-magnetic cylinder blank coaxially coupled to said magnetic cylinder blank; and a step of grinding the front portion of said stationary core blank to remove said chamfer and form a flat stationary attraction face, and subjecting inner peripheries of said non-magnetic cylinder blank and said magnetic cylinder blank to a grinding to form said annular recess, said center bore and said guide bore, the above steps being carried out sequentially.

4. An electromagnetic fuel injection valve according to claim 1, wherein said annular chamber is further defined by a space provided between said stationary and fixed attraction faces.

5. An electromagnetic fuel injection valve according to claim 1, wherein said movable attraction face is defined by a flat abutment face in communication with a slanted face extending away from said flat abutment face.

* * * * *